US008451131B2

(12) United States Patent
Ghazarian

(10) Patent No.: US 8,451,131 B2
(45) Date of Patent: May 28, 2013

(54) OFFENDER PRESENCE WARNING SYSTEM

(76) Inventor: Ohanes Der Ghazarian, Henderson, NV (US)

( * ) Notice: Subject to any disclaimer, the term of this patent is extended or adjusted under 35 U.S.C. 154(b) by 719 days.

(21) Appl. No.: 12/459,760

(22) Filed: Jul. 7, 2009

(65) Prior Publication Data

US 2010/0066545 A1 Mar. 18, 2010

Related U.S. Application Data

(60) Provisional application No. 61/134,683, filed on Jul. 9, 2008.

(51) Int. Cl.
*G08B 23/00* (2006.01)

(52) U.S. Cl.
USPC ..... 340/573.4; 340/539.15; 340/539.11; 340/539.13; 340/573.1

(58) Field of Classification Search
USPC ..... 340/539.1, 539.11, 539.13, 539.15, 340/539.21, 573.1, 573.4
See application file for complete search history.

(56) References Cited

U.S. PATENT DOCUMENTS 5,266,944 A * 11/1993 Carroll et al. ..... 340/573.4
5,396,227 A * 3/1995 Carroll et al. ..... 340/573.4
5,731,757 A * 3/1998 Layson, Jr. ..... 340/573.1
5,892,447 A * 4/1999 Wilkinson ..... 340/573.4
5,982,281 A * 11/1999 Layson, Jr. ..... 340/539.13
6,014,080 A * 1/2000 Layson, Jr. ..... 340/573.1
6,788,200 B1 * 9/2004 Jamel et al. ..... 340/539.13
6,998,985 B2 * 2/2006 Reisman et al. ..... 340/573.1
7,123,141 B2 * 10/2006 Contestabile ..... 340/539.13
7,289,031 B1 * 10/2007 Hock ..... 340/573.4
7,518,500 B2 * 4/2009 Aninye et al. ..... 340/506
7,804,412 B2 * 9/2010 Derrick et al. ..... 340/573.1
7,864,047 B2 * 1/2011 Aninye et al. ..... 340/539.13
8,013,736 B2 * 9/2011 Derrick et al. ..... 340/539.13
2002/0024443 A1 * 2/2002 Hawkins et al. ..... 340/573.1
2004/0174264 A1 * 9/2004 Reisman et al. ..... 340/573.4
2005/0040944 A1 * 2/2005 Contestabile ..... 340/539.13
2007/0139207 A1 * 6/2007 Agapi et al. ..... 340/573.4
2007/0279219 A1 * 12/2007 Warriner ..... 340/539.23
2008/0088437 A1 * 4/2008 Aninye et al. ..... 340/539.13
2008/0088438 A1 * 4/2008 Aninye et al. ..... 340/539.13
2008/0231462 A1 * 9/2008 Hobart ..... 340/686.6
2009/0174550 A1 * 7/2009 Aninye et al. ..... 340/539.13

* cited by examiner

*Primary Examiner* — Travis Hunnings

(57) ABSTRACT

Offender presence warning system comprises;
a tracking device securely attached to an offender limb, containing a GPS receiver and a wireless modem an RF transceiver designed to transmit at time interval RF signal. And a victim carry on RF transceiver device which receives offender tracking device transmitted signals when the offender is located within near proximity of a victim. The victim device in response to received RF transmitted signals from the tracking device, generates warning signal(s) to alert the victim the presence of an offender, and automatically transmits a RF signal(s) to the offender tracking device, which upon receipt of the RF signal generates alarm signal to warn the offender being too close to the victim, If the offender becomes non responsive, the offender tracking device transmits a signal to a monitoring station containing information to both the offender, and the victim unit ID along with GPS location information.

2 Claims, 3 Drawing Sheets

BLOCK DIAGRAM

OFFENDER PRESENCE WARNING SYSTEM

BACKGROUND OF THE INVENTION

The invention is used for tracking of offenders who are under court mandated restraining order program which does not allow offenders to follow, stalk or get to close to a victim (s), the system provides monitoring station knowledge if offender is located near proximity of a victim by the use of an offenders mount tracking GPS tracking bracelet device and a victim carry on RF warning device.

When a subject to be monitored is equipped with a GPS tracking bracelet device transmitting RF signals at time interval approaches a victim carrying an offender presence warning device, the victim warning device upon receipt of the RF transmitted signal(s) warns the victim of the presence of an offender near by audible or vibrating alarm signals and automatically establishes an RF communication link with the offender GPS tracking bracelet device, which upon receipt of the signal warns the offender of being to close to the victim and allows a preset time for offender to move away from the victim, if at a predetermine time the offender does not move away from victims proximity, the offender GPS tracking device transmits "offender in violation" signal to a monitoring station. The invention thus provides automatic GPS monitored when offender is in violation by the use of offender GPS tracking device which is designed to establish and communicate at a time interval with a victim carry on device when located near the proximity of a victim, and report such a condition to a monitoring station by the use of offender GPS bracelet device cellular or satellite communication module.

In a further embodiment of the invention wherein the victim unit receives the offender GPS bracelet device transmitted RF signal, the victim unit will generate audio/visual and or vibrating alarm signal to warn the victim of the presence of an offender, and accordingly the victim by pressing victim carry on unit emergency assistance button, the victim unit will transmit a signal to monitoring station containing information to the victim unit GPS location and create a wireless two way voice emergency call with central monitoring station for assistance In the past many different methods have been used for electronic monitoring of individuals, such that when offenders carrying a GPS receiver having a cellular communication module approaches a victim who is carrying a cellular phone, the monitoring station by use of cellular network receives offender location GPS information and triangulates that with victim cellular phone location received information signal and determines an approximate victim location, unfortunately this method found in prior art teaching using cellular signal triangulation for determining victims location cannot provide the victims location accurately as it may vary between 500 to 1000 meter radius.

Other prior art method being used such that when offenders carrying a GPS receiver device having a cellular communication module comes near proximity of a victim who is carrying a GPS warning device, upon establishing RF link with victim unit both units transmit GPS location information to a monitoring station, the station by use of cellular network receives offender and victim location GPS information and compares that with victim location and offender location information to determine if offender is near the victim. Unfortunately the method found in prior art teachings requires victim unit to have cellular module to report the victim GPS location, which would make the victim pay a monthly cellular phone bill, contrary to the teaching found in the present invention wherein only offender GPS tracking device requires to have a cellular modem since victim location is reported to a monitoring station by the use of offender GPS bracelet device.

Another method for offenders being monitored is restrained from entering the defined zone where a victim is located is accomplished by use of Map Geo-Fencing which in this case monitoring station set up geo zones forbidding offender to come close or enter a selected geographical zone, this method is useful only if the victim is been designated to stay in one or more fixed locations. This sort of teachings found in prior arts does not provide victim the freedom to move around in a city or around a country, because it will be impossible to monitoring stations to create new map geo fence every moment the victim moves around the city or a country.

And finally another approach is being taken in prior arts wherein when an offender found near proximity of a victim the victim carryon unit establishes a communication link with offender RF transceiver device and victim carry on device accordingly transmits a signal to a monitoring station containing information to both victim location and offender unit ID information to a monitoring station by the use of a GPS receiver and a cellular or satellite modem. Unfortunately such prior art teaching are not economically useful as it is a fact there are more ordinary people in comparison to one criminal, since prior art victim carryon device contains a GPS receiver and cellular/satellite module means many victims will be forced to pay monthly cellular service fee and purchase or lease expensive carry on warning devices to protect themselves from a criminal, compared to the present invention only the offender tracking unit contains GPS receiver and a cellular/Satellite module to notify monitoring station an offender being near a victim thus only offender will be paying monthly cellular or satellite service fee and higher priced GPS tracking bracelet device.

Related prior art teachings are found in U.S. Pat. No. 6,232,916 of Grillo et al. and U.S. Pat. No. 6,774,797 of Freathy et al. illustrating useful methods for tracking personnel or assets, in designated areas where a person, or asset, to be monitored is restrained from entering or exiting the defined zone.

U.S. Pat. No. 6,104,979 of Harrison, in which he teaches a communication method for both the asset requirement and communication channel occupancy in a reduced order. The asset is provided with an indication of its position so as to allow detection of movement of the asset.

U.S. Pat. No. 7,061,385 of Fong, et al. teaches a wireless tether apparatus such that when separated from a base station unit, greater than a predetermined distance, dynamic switching communication channels send information in the form of alarm sounds, displays, vibration sequences or combinations thereof.

U.S. Pat. No. 6,889,135 of Curatolo, et al. illustrate a method wherein if two signaling units are separated more than a pre-selected distance, signaling units are activated transmitting the location of the signaling units.

U.S. Patent Application Publication 2005/0017900 of Grimm teaches a method wherein a reed switch responsive to the magnetic field of a keeper plate, within a bank teller's drawer activates a GPS/cellular modem selectively controlling a cellular or RF transmitter to help recover stolen goods.

U.S. Patent Application Publication 2004/0012518 of Mohan illustrates a method wherein a module, in form of a bracelet, is adapted with a global position satellite receiver, a communications transmitter and a controller, operative to receive a request from a remote location causing the global positioning satellite receiver to receive and decode signals from global positioning satellites containing information relating to the geographic position of the module.

U.S. Patent Application Publication 2002/0018014 of Allen teaches a trigger-able remote controller having a trigger signal including a command; a GPS processor coupled to trigger signal, and a position signal carrying position information generated by the GPS processor in response to trigger signal. The trigger signal source comprises a page receiver with the trigger signal activating when the page receiver receives a page.

U.S. Pat. No. 6,236,358 of Durst, et al. teaches an object locator, such as an animal, carrying a mobile communication unit that includes a GPS receiver coupled with a pager transceiver. The GPS receiver may be selectively activated to conserve power by responding only when the GPS receiver is beyond or within a predetermined boundary.

U.S. Pat. No. 6,014,080 of Layson Jr. illustrates a body worn tracking device for use in a wireless communication system receiving signals from a global positioning system. The tracking device directly communicates selected coordinates within remote sites. The device case contains a battery, a signaling device, and a field programmable gate array for power saving.

U.S. Pat. No. 6,075,443 of Schepps et al. teach a method using a wireless tether worn on an article, transmitting a periodic identification signal. A receiving module located at a tether location receives identification signals if the tethered article moves away from the tether location at which time an alarm is raised.

U.S. Pat. No. 6,067,018 of Skelton et al. teaches a pet notification system having a pet collar that automatically activates an alarm when the pet becomes lost. A portable hand held unit continuously monitors the location of the pet. A base station automatically transmits a signal to the owner once portable unit determines that the pet is lost.

U.S. Pat. No. 5,870,029 of Otto et al. illustrate a system for monitoring the location or presence of an object/person within a selected area. The system includes a mobile base station, a control center, a mobile signaling device carried by the monitored object/person and geolocating means for retaining the monitored object/person within a desired area. An alarm condition is raised, when the monitoring object'person is not within this desired area.

U.S. Pat. No. 5,515,419 of Sheffer teaches a tracking system for tracking a portable phone, utilizing an array of fixed wireless signal transceivers forming part of a wireless telephone system. The phone unit generates an emergency signal on detection of an emergency condition, and transmits the emergency signal to a monitoring station via the wireless telephone network. The emergency signal includes information for identifying the phone.

U.S. Pat. No. 6,232,916 of Grillo et al. and U.S. Pat. No. 6,774,797 of Freathy et al. illustrating a methods for tracking personnel or assets, in designated areas where a person, or asset, to be monitored is restrained from entering or exiting the defined zone.

U.S. Pat. No. 6,014,080 to Layson Jr. Teaches a method wherein an offender monitoring bracelet containing a battery as power source, and a vibrator designed to vibrate to warn the user to charge the battery of the bracelet device.

U.S. Pat. No. 7,330,122 to Derrick, et al teaches a method wherein a offender monitoring device having a first battery removably affixed to the housing and a second battery electronically coupled to the processor, the position locator, the first transmitter, the second transmitter and the first battery to power a first TX utilized for wireless voice and data, and a second TX for voice and data communication, having a speaker and microphone.

U.S. Pat. No. 7,375,629 to Moyer; Dale Edon teaches a method for tracking location of a first class of user and a second class of user includes determining a location of a first class of user, updating a first class of user location database with the location of the first class of user, determining a location of a second class of user, updating a second class of user location database with the location of the second class of user, comparing location of the first class of user with the location of the second class of user, determining whether predetermined criteria related to the location of the first class of user with the location of the second class of user is met, and initiating a communication to one or more entities if the predetermined criteria is met.

Perhaps U.S. Pat. No. 5,867,103 and U.S. Pat. No. 6,160,481 to Taylor Jr. teaching found to be useful in the art, wherein a restrictee carrying an RF communication device becomes near a restrictor GPS/RF portable device, the restrictee device detects transmitted signals from restrictor device which creates an RF communication link with restrictor device and restrictor GPS/RF device transmits location information of restrictor by the use of the restrictor GPS device with a monitoring station.

As well as U.S. Pat. No. 6,218,945 to Taylor Jr. teaches a method wherein utilizing a trackee unit and a companion located in a fix location or mounted on a trackee used for obtaining location information of a trackee, If and when trackee unit and companion unit are separated the companion unit initiates a trackee location signal to a monitoring station.

And as well as U.S. Pat. RE 38838 AND U.S. Pat. RE 39909 to Taylor Jr. teaches a method wherein restrictee carrying a GPS device located near proximity of RF communication range with restrictor GPS device both device contain GPS receiver and Cellular or satellite communication module, and both units transmit location information signal to a detached to relay the location information to a monitoring station.

Unfortunately teaching found in U.S. Pat. No. 5,867,103 and U.S. Pat. No. 6,160,481 to Taylor Jr. prior arts such that usage of restrictor device to establish GPS location information via cellular or satellite network with a monitoring station may not be suitable in many applications, such example presuming there are 1000 children or youngsters at a school if all the children are to be protected from a sex offender, in this case all 1000 children parents have to purchase high priced restrictor (Child unit) units having a GPS receiver and a cellular/satellite modem device, and in addition each parent would be expected to pay a monthly cellular/satellite service fee, thus Taylor Jr. teaching becomes unpractical and a economic burden, contrary to the present invention wherein only Offender tracking unit (Restrictee) contains GPS receiver and Cellular/Satellite modem, also in the preset art each child carry on warning device does not contain a GPS receiver and Cellular/satellite modem, therefore usage of child warning device found in present art requires no monthly service fee and each carry on warning device is inexpensive and affordable to the parent, The same will apply if adults are to use the carry on warning device to protect themselves.

In addition to Taylor Jr. later teachings Pat. RE 38838 AND U.S. Pat. RE 39909 wherein both restrictee and restrictor units report location information to a monitoring station wherein both restrictor and restrictee unit utilizing GPS and cellular/Satellite module to relay location information to both restrictor and restrictee to a monitoring station, again the teaching method found in prior art requires restrictor to pay monthly communication service fee and purchase or lease higher priced carry on warning device.

Never less prior art teaching found in US patents, as well as the other prior art GPS tracking systems found are important and useful background to the present invention, but none of prior art teaching illustrates the use of an offender presence warning system wherein the device utilizes a low cost affordable victim carryon device that requires to contain, a processor, an RF transceiver and a beeper or vibrator, which requires no monthly service fee for the victim to pay, and have an offender tracking bracelet device which reports when an offender becomes to close to a victim, by the use of offender tracking bracelet device GPS receiver and cellular/Satellite module.

It is accordingly the primary objective of the present invention to provide an offender presence warning device to a victim which is compact in size, affordable and requires no monthly fee for the victim to pay, therefore many individuals can afford to protect themselves from criminals, sex offenders, rapists, stockers, spouse abusers etc.

It is secondary objection of the present invention wherein to provide two way hands free voice conversation to the victim with a monitoring station, by victim pressing an emergency assistance button on victim unit, or by when an offender is near by the victim, victim unit automatically opens a two way conversation with monitoring station.

SUMMARY OF THE INVENTION

Invention is used for tracking of offenders whom are under court mandated restraining order program which does not allow offenders to follow, stalk or get to close to a victim(s), the system provides monitoring station knowledge if an offender comes in close proximity of a victim by the use of an offenders mount tracking GPS bracelet device and a victim carry on RF warning device.

When a subject to be monitored equipped with a GPS tracking bracelet device transmitting RF signals at time interval approaches a victim carrying an offender presence warning device, the victim warning device upon receipt of the RF transmitted signal(s) warns the victim of the presence of an offender by audible or vibrating alarm signals and automatically establishes an RF communication link with the offender GPS tracking bracelet device, which upon receipt of the signal warns the offender of being to close to the victim and allows a preset time for offender to move away from the victim, if at a predetermined time the offender does not move away from victims proximity, the offender GPS tracking device transmits "offender in violation" signal to a monitoring station. The invention thus provides automatic GPS monitoring when offender is in violation by the use of offender GPS tracking device which is designed to establish communication at time interval with a victim carry on device when it is located near the proximity of a victim, and report such a condition to a monitoring station by the use of offender GPS bracelet device cellular or satellite communication module.

In a preferred embodiment of the present invention wherein the victim carry on RF warning device may have a cellular or satellite modem to communicate with a monitoring station, wherein when the offender becomes not responsive to the received warning signals and take proper course of action, the victim carry on warning unit automatically create a wireless cellular or satellite two way emergency voice communication with the central monitoring station for assistance, and or transmits the offender tracking unit ID to the monitoring station.

In a further embodiment of the invention wherein when the victim unit receives the offender GPS bracelet device transmitted RF signal, the victim unit will generate audio/visual and or vibrating alarm signal to warn the victim of the presence of an offender, and accordingly the victim will press the victim carry on unit emergency assistance button, to establish a communication link with a monitoring station containing information to the offender tracking bracelet device ID and create a wireless two way emergency voice communication with the central monitoring station for assistance.

DETAILED DESCRIPTION OF THE INVENTION

Figure 1:
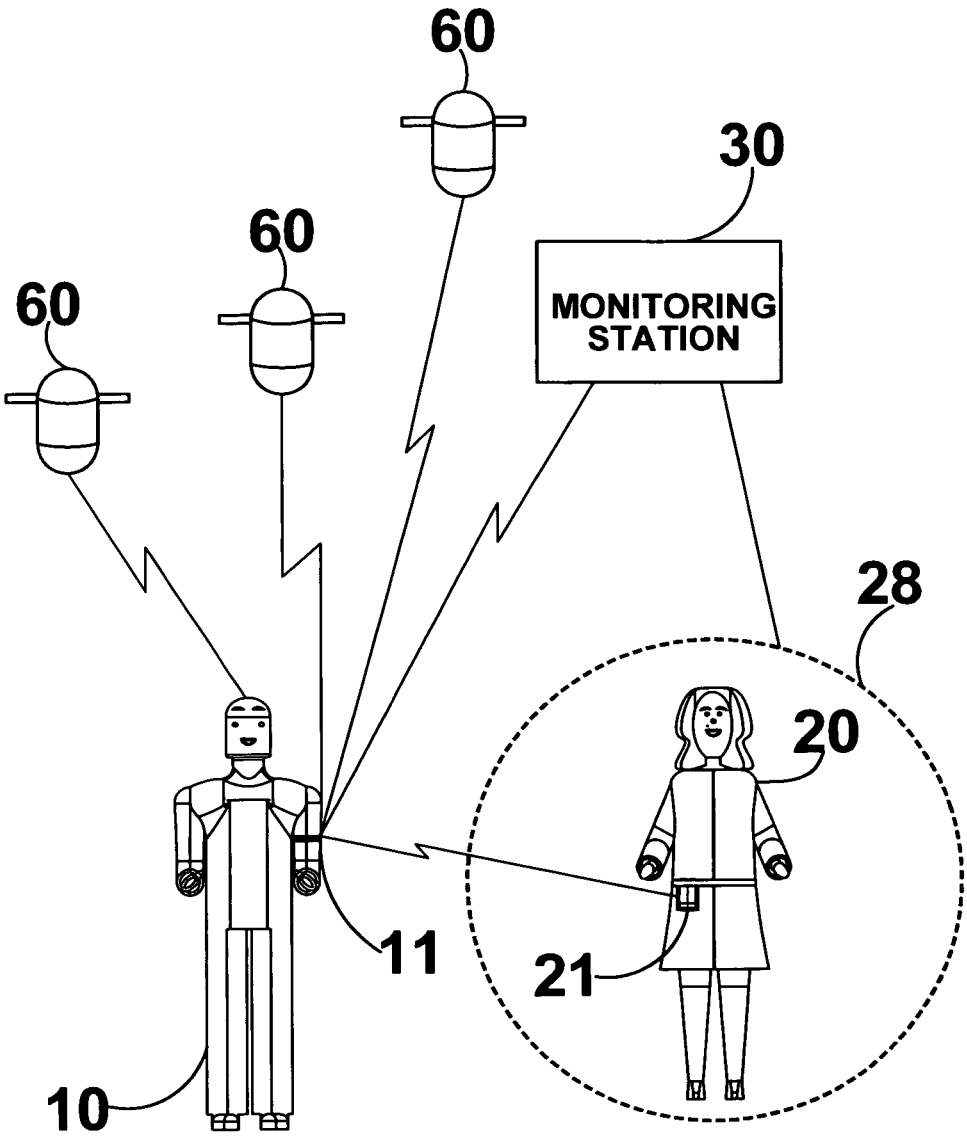
FIG. 1 Describes an offender equipped with Offender tracking bracelet device, a victim carrying offender presence warning device, a Monitoring station and orbiting satellites.
Figure 2:
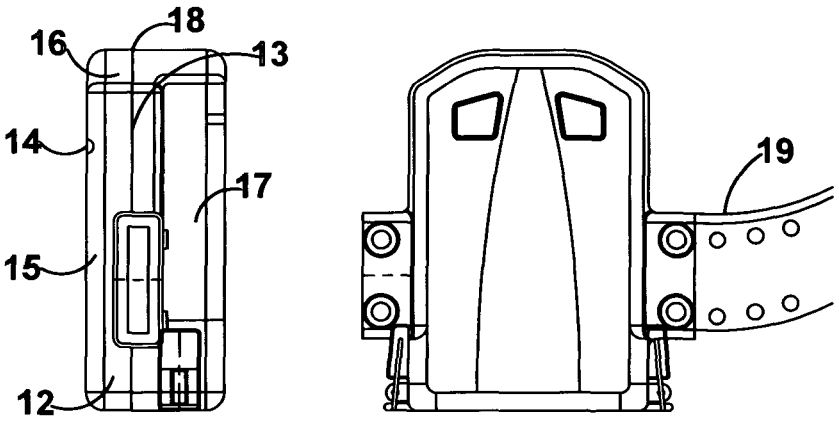
FIG. 2 Describes a offender tracking bracelet device.
Figure 3:
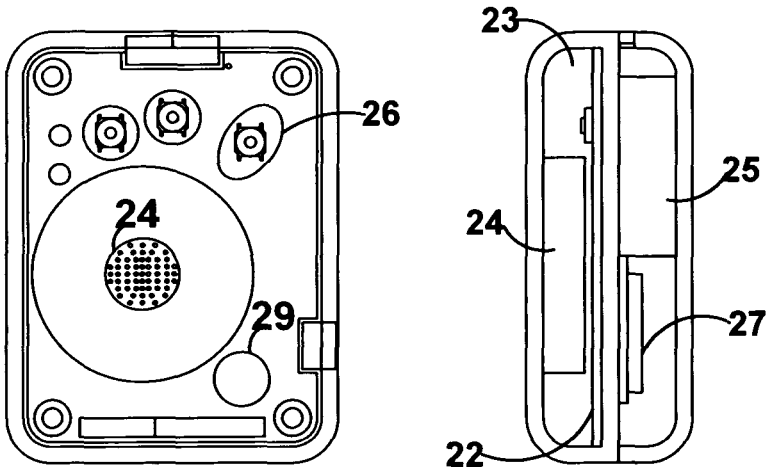
FIG. 3. Describes a victim carry on offender presence warning device.
Figure 4:
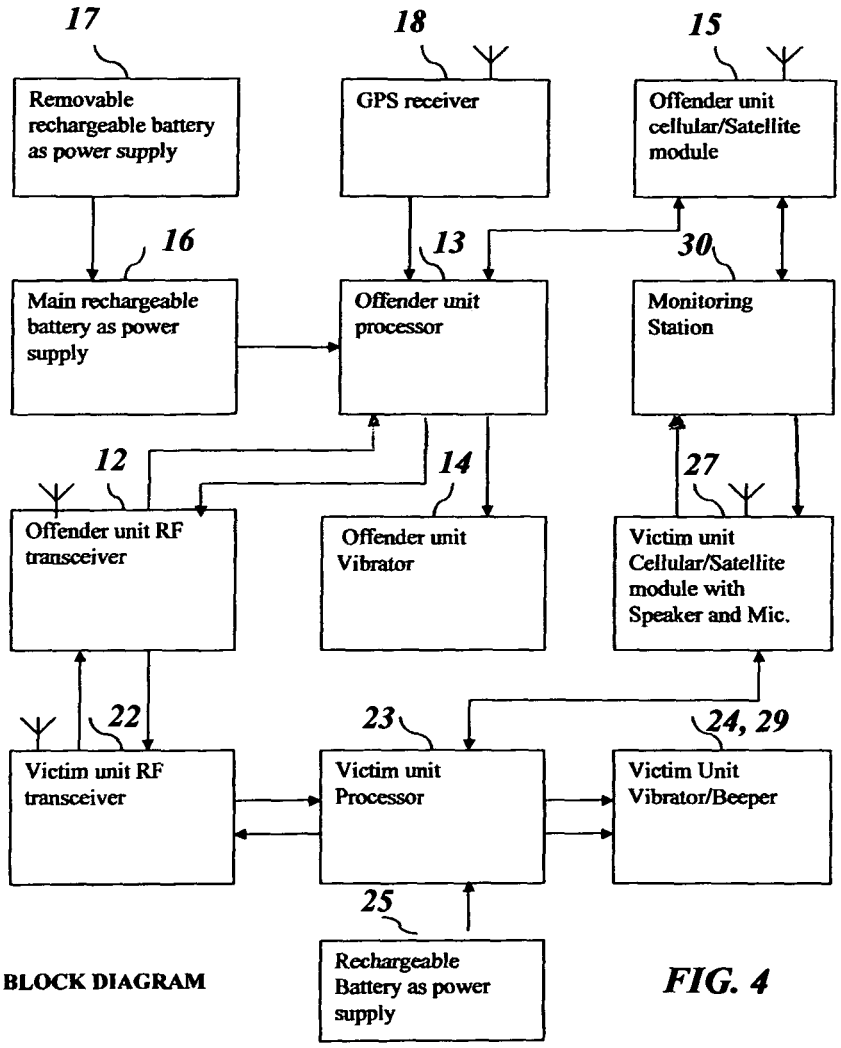
FIG. 4. Is detailed block diagram.

Offender presence warning system comprising of; a GPS tracking bracelet device 11 having a tamper detection strap 19 used for attaching the device to an offender limb 10 which contains a GPS receiver 18 to receive GPS coordination signals from orbiting satellites 60 and a cellular or satellite modem 15 to establish communication with a monitoring station 30, a processor 13 and an RF transceiver 12 designed to transmit at time interval uniquely coded RF signal, end a victim carry on RF transceiver 21 device having an RF transceiver 22 to communicate with the offender tracking bracelet device 11, a processor 23 and may have a cellular/satellite module 27 to communicate with a monitoring station 39.

When a subject 10 to be monitored equipped with a GPS tracking bracelet device 11 transmitting RF signals through it's transmitter 12 at time interval approaches near proximity 28 of a victim 20 which carrying an offender presence warning device 21, the victim warning device transceiver 22 upon receipt of the RF transmitted signal(s) 12, the victim unit processor 23 activates victim unit vibrator 29 or beeper 24 to warn the victim 20 the presence of an offender 10 near by audible or vibrating alarm signals and automatically establishes an RF communication leak with the offender GPS tracking bracelet device 11 RF transceiver 12, which upon receipt of the signal the on board processor 13 vibrates the built-in vibrator 14 to warns to the offender 10 being to close to the victim 20 and allows a preset time for offender 10 to move away from the victim 20, if at predetermine time the offender 10 does not move away from victim's 20 proximity, the offender GPS tracking bracelet device 11 transmits "offender in violation" signal to a monitoring station 30. The invention thus provides automatic GPS monitored when an offender 10 is in violation by court mandated system by the use of offender GPS tracking device 11 which is designed to establish communication at time interval with a victim carry on device 21 when it is located near the proximity 28 of a victim 20, and report such a condition to a monitoring station 30 by the use of offender GPS bracelet device cellular or satellite communication module 15.

In a preferred embodiment of the invention If the offender 10 becomes none responsive to said received vibrating warning signal(s), the victim carryon warning device 21 automatically create a wireless cellular or satellite 27 two way emergency voice call with central monitoring station 30 for assistance, and or transmits said offender tracking unit 11 ID to said monitoring station 30.

In a further embodiment of the invention wherein when the victim unit 21 receives the offender GPS bracelet device 11 transmitted RF signal 13, the victim unit 21 will generate audio/visual and or vibrating alarm signals 24 to warn the victim 20 to the presence of an offender 10, and accordingly the victim will press the victim carry on unit emergency assistance button 26, and the victim unit 21 will establishes a cellular/Satellite communication signal 27 to monitoring station 30 and create a wireless two way emergency voice call with central monitoring station 30 for assistance.

The offender GPS tracking bracelet device 11 of the present invention utilizes two researchable batteries as power source, main researchable battery 16 to provide constant power for offender GPS receiver 18, cellular/satellite module 15, and the processor circuitry 13, and a second removable rechargeable battery 17 is used for charging the main battery 16, the teaching is useful to charge offender tracking device 11 main battery 16 in remote locations.

The invention claimed is:

1. Offender presence warning system comprising;

a GPS tracking device securely attached to an offender limb which contains;

a battery or other power means to supply power to said GPS tracking device a GPS receiver to receive GPS coordination signals from orbiting satellites, and a cellular, satellite or a wireless RF module to establish long range communication with a monitoring station, a processor and an RF transceiver designed to transmit at time interval uniquely coded low power short range RF signals, end a victim carry on RF transceiver warning device having, a battery or other power means to supply power to said victim unit, a beeper and a vibrator, a low power RF transceiver which is designed to receive said offender tracking device transmitted RF signals when said offender is located within near proximity of said victim, the victim carry on device processor in response to received RF transmitted signals from said offender GPS tracking device, said victim unit processor circuitry generates an audio/visual and or vibrating warning alarm signal(s) to alert the victim to the presence of an offender near by, and accordingly said victim device automatically transmits a uniquely coded RF signal to said offender tracking device, which upon receipt of said signal generates audio and or vibrating alarm signal to warn the offender being close to the victim and allow said offender a preset time to move away from said victim, If said offender becomes none responsive to said received warning signal(s), at a pre-determine time said offender GPS tracking device transmits violation signal to a monitoring station containing information both to said offender unit ID, and to said victim unit ID along with GPS location information of offender.

2. Offender presence warning system as claimed in claim 1 wherein said offender GPS tracking bracelet device utilizes two researchable batteries as power source, main researchable battery to provide constant power to said offender tracking device, GPS receiver, RF transceiver, cellular/satellite module, and to said processor circuitry, and utilizes a second removable rechargeable battery which is used for charging the main battery in remote locations.

* * * * *